US005671476A

United States Patent [19]

Ishiguro et al.

[11] Patent Number: 5,671,476

[45] Date of Patent: Sep. 23, 1997

[54] IMAGE FORMING MACHINE WITH CLEANING DRUM BRUSH DRIVEN BY ROTATING DRUM

[75] Inventors: Yasuyuki Ishiguro; Kazuhiro Kimura; Hiroaki Yamaguchi; Hiroyuki Tsuji; Masaru Watanabe, all of Osaka, Japan

[73] Assignee: Mita Industrial Co., Ltd., Osaka, Japan

[21] Appl. No.: 587,271

[22] Filed: Jan. 18, 1996

[30] Foreign Application Priority Data

Feb. 2, 1995 [JP] Japan ..... 7-15724

[51] Int. Cl.[6] ..... G03G 21/00

[52] U.S. Cl. ..... 399/354; 399/353

[58] Field of Search ..... 355/301, 303, 355/297; 15/1.51, 256.5, 256.52; 399/343, 353, 354

[56] References Cited

U.S. PATENT DOCUMENTS

| | | | |
|---|---|---|---|
| 3,918,080 | 11/1975 | Narita | 355/297 |
| 3,918,808 | 11/1975 | Narita | 355/297 |
| 3,957,509 | 5/1976 | McMullen et al. | 355/297 |
| 4,741,942 | 5/1988 | Swift | 15/1.51 |
| 5,264,904 | 11/1993 | Audi et al. | 355/299 |
| 5,600,405 | 2/1997 | Umeda et al. | 399/71 |

FOREIGN PATENT DOCUMENTS 56-43656 4/1981 Japan .

*Primary Examiner*—Arthur T. Grimley
*Assistant Examiner*—Quana Grainger
*Attorney, Agent, or Firm*—Beveridge, DeGrandi, Weilacher & Young, LLP

[57] ABSTRACT

An image forming machine comprising a rotating drum mounted rotatably and having a photosensitive material disposed on the peripheral surface thereof; a rotating drive source for causing the rotating drum to rotate; an image forming means for forming a toner image on the photosensitive material in an image forming zone; a transfer means for transferring the toner image on the photosensitive material onto an image receiving member in a transfer zone located downstream of the image forming zone as viewed in the direction of rotation of the rotating drum; and a cleaning means which acts on the photosensitive material in a cleaning zone located downstream of the transfer zone but upstream of the image forming zone as viewed in the direction of rotation of the rotating drum. The cleaning means includes a cylindrical brush formed of a multiplicity of radially extending yarns. The brush of the cleaning means is mounted rotatably about the central axis of rotation extending substantially parallel to the central axis of rotation of the rotating drum, is pressed against the photosensitive material, and is caused to rotate following the rotation of the rotating drum.

7 Claims, 3 Drawing Sheets

IMAGE FORMING MACHINE WITH CLEANING DRUM BRUSH DRIVEN BY ROTATING DRUM

FIELD OF THE INVENTION

This invention relates to an image forming machine such as an electrostatic copying machine or printing machine. More specifically, it relates to an image forming machine of the type forming a toner image on a photosensitive material disposed on the peripheral surface of a rotating drum, and transferring the toner image onto an image receiving member.

DESCRIPTION OF THE PRIOR ART

As is well known, an image forming machine equipped with a rotating drum having a photosensitive material disposed on its peripheral surface is in wide use. The rotating drum is rotationally driven in a predetermined direction by a rotating drive source which may be an electric motor, whereby the photosensitive material is moved through an image forming zone, a transfer zone and a cleaning zone in this order. In the image forming zone, a latent electrostatic image is usually formed on the photosensitive material, and then developed into a toner image. In the transfer zone, the toner image on the photosensitive material is transferred onto an image receiving member which may be a paper. The toner image transferred onto the image receiving member is fixed there, so that a desired image is formed on the image receiving member. In the cleaning zone, the toner remaining on the photosensitive material after transfer is removed from the photosensitive material.

The cleaning means proposed is one of a shape including a cylindrical brush in combination with, or rather than, a rubber blade having a free end to be pressed against the photosensitive material. The brush is formed of a multiplicity of radially extending yarns, and is pressed against the photosensitive material. Such a brush is rotationally driven in a direction opposite to the direction in which the rotating drum is moved. The peripheral speed of the brush is set to be substantially the same as or slightly lower than the peripheral speed of the rotating drum.

The experience we, the inventors, have gained shows that in an image forming machine provided with a cleaning means including a rotationally driven brush, the rotation of the rotating drum is not sufficiently uniform but uneven; that is, considerable variations exist in the peripheral speed of the rotating drum. When the image forming machine is not in operation, the brush of the cleaning means has only a specific-angle site pressed against the photosensitive material. Owing to this state, the yarns locally tend to be inclined in a peripheral direction, rather than extending radially, at the specific-angle site of the brush. Once such a local inclination of the yarns is produced, the aforementioned variations in the peripheral speed of the rotating drum become marked. These variations in the peripheral speed of the rotating drum cause a defect, such as distortion, to the toner image formed on the photosensitive material disposed on the peripheral surface of the rotating drum.

SUMMARY OF THE INVENTION

A main object of the present invention is to improve an image forming machine having a cleaning means including a brush so that the rotating drum may be rotated sufficiently uniformly.

Another object of the present invention is to improve an image forming machine having a cleaning means including a brush so that the cleaning means can clean the photosensitive material sufficiently satisfactorily without hampering the sufficiently uniform rotation of the rotating drum.

To attain the above objects, the present invention does not rotationally drive the brush of the cleaning means, but simply mounts it rotatably and presses it against the photosensitive material so that it is caused to rotate following the rotation of the rotating drum.

That is, as the image forming machine achieving those objects, the present invention provides an image forming machine comprising a rotating drum mounted rotatably and having a photosensitive material disposed on the peripheral surface thereof; a rotating drive source for causing the rotating drum to rotate; an image forming means for forming a toner image on the photosensitive material in an image forming zone; a transfer means for transferring the toner image on the photosensitive material onto an image receiving member in a transfer zone located downstream of the image forming zone as viewed in the direction of rotation of the rotating drum; and a cleaning means which acts on the photosensitive material in a cleaning zone located downstream of the transfer zone but upstream of the image forming zone as viewed in the direction of rotation of the rotating drum, the cleaning means including a brush means having a cylindrical brush formed of a multiplicity of radially extending yarns; wherein the brush of the cleaning means is mounted rotatably about the central axis of rotation extending substantially parallel to the central axis of rotation of the rotating drum, is pressed against the photosensitive material, and is caused to rotate following the rotation of the rotating drum.

Preferably, the fineness of the yarns is 18 to 50 deniers, the density of the yarns is 40,000 to 70,000 yarns/inch$^2$, and the length in the radial direction of the yarns is 3 to 7 mm. Also preferably, the yarns are conductive, and a direct current cleaning voltage is applied between the brush and the photosensitive material. The yarns may be formed of carbon-containing rayon yarns. In a preferred embodiment, the cleaning means includes a rubber blade to be pressed against the photosensitive material on the downstream side of the brush as viewed in the direction of rotation of the rotating drum.

As will be seen from the Examples and Comparative Examples to be offered later, according to the image forming machine of the present invention in which the brush of the cleaning means is caused to rotate following the rotation of the rotating drum, variations in the peripheral speed of the rotating drum are markedly decreased in comparison with the brush of the cleaning means being positively rotationally driven.

DETAILED DESCRIPTION OF THE PREFERRED EMBODIMENTS

Preferred embodiments of the image forming machine constituted in accordance with the present invention will be described in detail with reference to the appended drawings.

Figure 1:
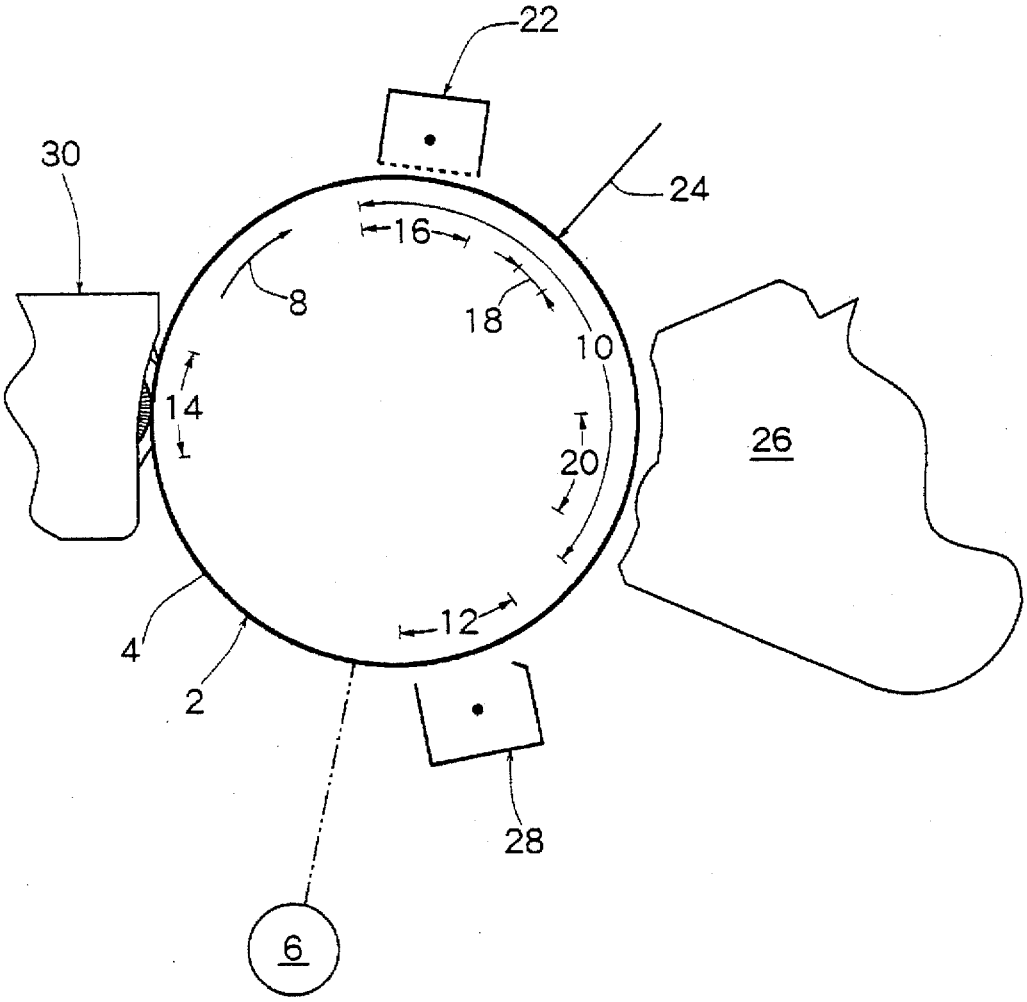
FIG. 1 is a schematic view showing main constituent elements of an image forming machine constituted in accordance with the present invention.

With reference to FIG. 1, the illustrated image forming machine has a rotating drum 2 rotatably mounted thereon. A photosensitive material 4 is disposed on the peripheral surface of the rotating drum 2. The rotating drum 2 is drivably connected to a rotating drive source 6, optionally an electric motor, via a suitable transmission means (not shown), and is rotationally driven in the direction of arrow 8 by the rotating drive source 6. Around the rotating drum 2 are disposed an image forming zone 10, a transfer zone 12 and a cleaning zone 14 in this order as viewed in the direction of rotation indicated by the arrow 8. The image forming zone 10 includes a charging zone 16, an exposure zone 18 and a developing zone 20. In the charging zone 16, the photosensitive material 4 is charged substantially uniformly to a predetermined polarity (e.g. charged to +1,000 V) by a charging corona discharger 22. In the exposure zone 18, the photosensitive material 4 is exposed in correspondence with an image to be formed, as briefly illustrated by an arrow 24, whereby a latent electrostatic image is formed on the photosensitive material 4. In the developing zone 20, a developing device 26 of a suitable shape, such as a magnetic brush type developing device, applies a toner to the latent electrostatic image, developing it to a toner image. In the transfer zone 12, the surface of an image receiving member (not shown), optionally a sheet of paper, is intimately contacted with the photosensitive material 4, and simultaneously a corona discharge for transfer is applied to the back of the image receiving member by a transfer corona discharger 28. Thus, the toner image on the photosensitive material 4 is transferred onto the image receiving member. The image receiving member having the toner image transferred thereto is separated from the photosensitive material 4, and conveyed to a fixing means (not shown). The toner image is fixed by the fixing means to obtain a copy or a print. In the cleaning zone 14, the toner remaining on the photosensitive material 4 is removed from the photosensitive material 4 by the action of a cleaning means entirely indicated at 30.

Figure 2:
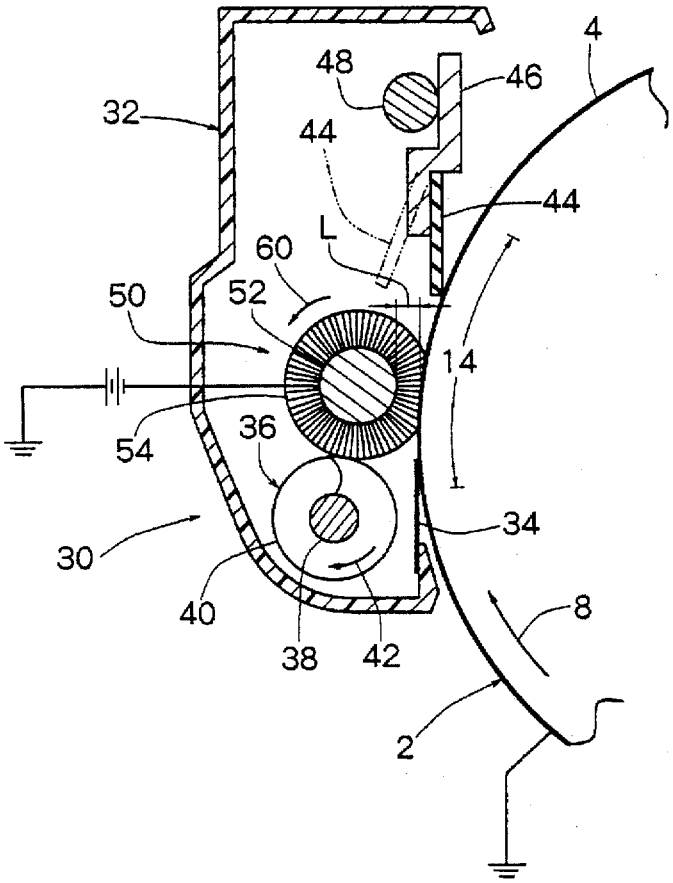
FIG. 2 is a sectional view showing a cleaning means in the image forming machine of FIG. 1.

With reference to FIG. 2 along with FIG. 1, the illustrated cleaning means 30 includes a cleaning housing 32 having a side surface facing the rotating drum 2 caused to open. At a lower end portion of the housing 32 is disposed a sealing member 34 extending upward from its base portion fixed to the housing 32. Art upper end portion or a free end portion of the sealing member 34 which may be formed of a suitable plastic film such as a polyurethane film is contacted, at a relatively small pressure, with the photosensitive material 4 disposed on the surface of the rotating drum 2. Behind the sealing member 34, i.e., on the left side in FIG. 2, is disposed a spiral blade mechanism 36 extending in the direction of the central axis of rotation of the rotating drum 2 (the direction perpendicular to the sheet surface in FIG. 2). The spiral blade mechanism 36 is composed of a rotating shaft 38 mounted rotatably, and a spiral blade 40 formed on the rotating shaft 38. The rotating shaft 38 is drivably connected to the rotating drum 2 via a suitable transmission means (not shown) such as a transmission gear train, and is rotationally driven in the direction of arrow 42 when the rotating drum 2 is rotationally driven in the direction of arrow 8. A blade 44 is disposed at an upper portion of the housing 32. The blade advantageously formed of a suitable synthetic rubber such as polyurethane rubber, is in the form of a strip slenderly extending along the rotating drum 2. The base portion of the blade 44 (the upper portion in FIG. 2) is fixed to a blade holder 46, which is fixed to a pivot shaft 48. The pivot shaft 48 extending substantially parallel to the central axis of the rotating drum 2 is equipped with an actuating means (not shown) which may be a solenoid. When the rotating drum 2 is at a stop, the actuating means is deenergized, and the blade 44 is rendered apart from the photosensitive material 4 disposed on the peripheral surface of the rotating drum 2, as illustrated by a two-dot chain line in FIG. 2. When the rotating drum 2 is rotationally driven in the direction of arrow 8, the actuating means is energized, and a lower end portion or free end portion of the blade 44 is pressed against the photosensitive material 4 disposed on the peripheral surface of the rotating drum 2, as illustrated by a solid line in FIG. 2. The cleaning means 30 further includes a brush means 50 disposed upstream of the blade 44 as viewed in the direction of rotation of the rotating drum 2 indicated by the arrow 8. The structure other than the brush means 50 (to be described in greater detail) in the illustrated image forming machine does not constitute novel features improved in accordance with the present invention. Thus, a detailed explanation for the constituent elements other than the brush means 50 will be omitted in the instant specification.

The brush means 50 of the cleaning means 30 will be described with reference to FIG. 3 together with FIG. 2. The brush means 50 is composed of a supporting shaft 52, and a cylindrical brush 54 mounted on the supporting shaft 52. The supporting shaft 52 may be formed of a round bar of a conductive metal, e.g., an electrolessly nickel plated steel bar. As will be clearly seen from FIG. 3, the cleaning housing 32 has a pair of end walls 56 and 58 disposed at a distance in the direction of the central axis of the rotating drum 2. The opposite end portions of the supporting shaft 52 are mounted rotatably by the end walls 56 and 58 via suitable bearing means (not shown). Such supporting shaft 52 extends substantially parallel to the central axis of the rotating drum 2.

The brush 54 of the brush means 50 is formed of a multiplicity of radially extending yarns. In a preferred embodiment, it is in the form of many yarns whose ends are secured to a conductive adhesive layer solidified in a cylindrical shape. The solidified conductive adhesive layer forming the base layer of the many yarns is fixed, at a plurality of positions spaced apart in the axial direction, to the peripheral surface of the supporting shaft 52 via a suitable fixing means such as a double-sided adhesive tape. The many yarns constituting the brush 54 are preferably conductive per se. A preferred example of the conductive yarn is a carbon-containing rayon yarn marketed by Unitika Ltd. under the trade name "Rec-C". The conductive brush 54 formed of the conductive yarn is electrically connected to the supporting shaft 52 via the conductive adhesive layer. As will be seen from FIG. 2, the length in the radial direction of the many yarns constituting the brush 54 is set to be somewhat larger than the distance L between the supporting shaft 52 and the photosensitive material 4 disposed on the peripheral surface of the rotating drum 2, so that the brush 54 is pressed against the photosensitive material 4 disposed on the peripheral surface of the rotating drum 2. Thus, when the rotating drum 2 is rotationally driven in the direction of arrow 8, the brush means 50 composed of the supporting shaft 52 and the brush 54 is caused to rotate, in a following manner, in the direction of arrow 60. The width of the brush means 50 (the length in the right-and-left direction in FIG.

3) is set to be somewhat larger than the width of the rotating drum 2, so that the opposite end portions of the brush 54 are caused to protrude beyond the opposite edges of the rotating drum 2. Between the supporting shaft 52 of the brush means 50 and the grounded photosensitive material 4 is advantageously applied a cleaning voltage. For instance, if the photosensitive material 4 is charged to about +1,000 V in the charging zone 16, and the toner charged negatively is applied to the photosensitive material 4 in the developing zone 20, then it is preferred that a cleaning voltage of about −250 V is applied to the supporting shaft 52, and accordingly, the brush 54.

The fineness (thickness) of the yarns constituting the brush 54 is preferably about 18 to 50 deniers. The density of the yarns in the brush 54 is preferably about 40,000 to 70,000 yarns/inch$^2$. The length in the radial direction of the yarns constituting the brush 54 is preferably about 3 to 7 mm, while the distance L between the supporting shaft 52 of the brush means 50 and the photosensitive material 4 is preferably set to be about 1 mm shorter than the length in the radial direction of the yarns. As will be understood from the descriptions of the Examples to be offered later, if the fineness of the yarns is too small and/or the density of the yarns is too small, the rigidity of the brush 54 becomes too small. Consequently, the brush means 50 does not rotate smoothly following the rotation of the rotating drum 2, with the result that the desired cleaning effect of the brush means 50 is lowered. If the fineness of the yarns is too large and/or the density of the yarns is too large, on the other hand, the rigidity of the brush 54 becomes too large, damaging the photosensitive material 4. There is also the tendency that it becomes difficult to make the pressure of contact between the brush 54 and the photosensitive material 4 sufficiently uniform in the direction of the central axis of the rotating drum 2. Furthermore, too high a rigidity of the brush 54 would increase the torque necessary to cause the rotating drum 2 to rotate.

The actions of the cleaning means 30 provided with the brush means 50 will be summarized by reference to FIG. 2. When the rotating drum 2 is rotationally driven in the direction of arrow 8, the brush means 50 is caused to rotate in a following manner in the direction of arrow 60. As will be seen from the descriptions of the Examples and Comparative Examples to be offered later, the brush means 50 in the image forming machine improved in accordance with the present invention is adapted to be caused to rotate following the rotation of the rotating drum 2 without being positively driven rotationally. Thus, the smooth rotation of the rotating drum 2 is not impeded by the brush means 50, but the rotating drum 2 is caused to rotate sufficiently smoothly. Variations in the peripheral speed of the rotating drum 2, if any, are slight. The brush means 50 acts on the photosensitive material 4 relatively gently, removing from the top of the photosensitive material 4 paper dust (such paper dust can adhere onto the photosensitive material 4 after separating from the paper constituting the image receiving member) and carrier particles (some carrier particles can adhere onto the photosensitive material 4 if the developer used with the developing device 26 is a so-called two-component developer containing a toner and carrier particles). The remaining toner on the photosensitive material 4 is also removed, at least partially, from the top of the photosensitive material 4 by the action of the brush means 50. Furthermore, the remaining charge on the photosensitive material 4 is eliminated, at least partially, owing to the cleaning voltage applied to the brush means 50. Then, the blade 44 disposed downstream of the brush means 50 as viewed in the direction of rotation of the rotating drum 2 indicated by the arrow 8 acts on the photosensitive material 4, removing the remaining toner from the top of the photosensitive material 4. The toner (as well as paper dust and carrier particles) removed from the photosensitive material 4 by the brush means 50 and blade 44 is caused to fall on the lower portion of housing 32 and collected there. The sealing member 34 prevents the toner (as well as paper dust and carrier particles), removed from the photosensitive material 4, from scattering below through the gap between the housing 32 and the photosensitive material 4. The spiral blade mechanism 36 disposed at the lower portion of the housing 32 conveys the toner (as well as paper dust and carrier particles), collected at the lower portion of the housing 32, forward or rearward in the direction perpendicular to the sheet face in FIG. 2, bringing it or them into a collecting container (not shown).

In the illustrated embodiment, the blade 44 as well as the brush means 50 is disposed in the cleaning means 30. If the remaining toner on the photosensitive material 4 can be removed fully satisfactorily by the action of the brush means 50, however, the blade 44 may be omitted.

Next, the Examples and Comparative Examples will be described.

EXAMPLE 1

Figure 3:
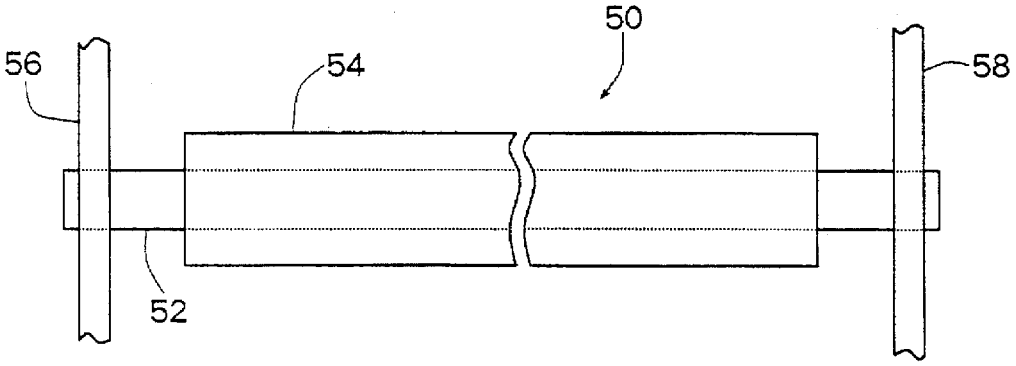
FIG. 3 is a sectional view showing a brush means in the cleaning means of FIG. 2.

An electrostatic copying machine having a rotating drum and a cleaning means of shapes as illustrated in FIGS. 1 to 3 was produced. The rotating drum had an amorphous silicon photosensitive material on the peripheral surface of an aluminum drum, and its outside diameter was 100 mm. The brush means in the cleaning means was composed of a supporting shaft, and a brush mounted thereon. The supporting shaft was an electrolessly nickel plated round steel bar, and its outside diameter was 10 mm. The brush was formed of carbon-containing rayon yarns marketed by Unitika Ltd. under the trade name "Rec-C". It was a cylindrical brush made of the yarns whose ends were secured to a conductive adhesive layer. Such a brush was fixed, at three positions spaced apart in the direction of the central axis, to the supporting shaft by means of a double-sided adhesive tape. The fineness of the yarns was 30 deniers, the density of the yarns was 47,000 yarns/inch$^2$, and the length in the radial direction of the yarns was 5 mm. The distance L between the supporting shaft of the brush means and the photosensitive material disposed on the peripheral surface of the rotating drum was set at 4 mm. The rotating drum was connected to a rotating drive source via a transmission gear. The rotating drive source was a DC servomotor marketed by Shinko Electric Co., Ltd. Japan under the trade name "DF 105W-T-A37". The photosensitive material disposed on the peripheral surface of the rotating drum was grounded, and a cleaning voltage of −250 V was applied to the brush means of the cleaning means.

In the above-described copying machine, the rotating drum was rotationally driven at a peripheral speed of 400 mm/second, and the brush means of the cleaning means was caused to rotate following the rotation of the rotating drum. The rotations of the rotating drum, the rotating drive source and the brush means were measured by a non-contact tachometer marketed by Simpo Kogyo Kabushiki Kaisha under the trade name "Hand Digital Tachometer DT-205". Based on the results, the peripheral speed of the brush means, the variation rate of the peripheral speed of the rotating drive source, and the variation rate of the peripheral speed of the rotating drum were calculated. Furthermore, 10 copies of an ordinary document containing many characters were prepared to check for local distortion of the characters on the copies. The results were as shown in Table 1.

Comparative Example 1

The rotations of the rotating drum, the rotating drive source and the brush means were measured, and the variation rate of the peripheral speed of the rotating drive source, and the variation rate of the peripheral speed of the rotating drum were calculated, under substantially the same conditions as in Example 1, except that the supporting shaft of the brush means in the cleaning means was drivably connected to the rotating drum via a transmission gear train, and that the brush means was positively rotationally driven at a peripheral speed of 400 mm/second. Furthermore, 10 copies of an ordinary document containing many characters were prepared to check for local distortion of the characters on the copies. The results were as shown in Table 1.

Comparative Example 2

The rotations of the rotating drum, the rotating drive source and the brush means were measured, and the variation rate of the peripheral speed of the rotating drive source, and the variation rate of the peripheral speed of the rotating drum were calculated, under substantially the same conditions as in Example 1, except that the supporting shaft of the brush means in the cleaning means was drivably connected to the rotating drum via a transmission gear train, and that the brush means was positively rotationally driven at a peripheral speed of 392 mm/second. Furthermore, 10 copies of an ordinary document containing many characters were prepared to check for local distortion of the characters on the copies. The results were as shown in Table 1.

TABLE 1

| | Example 1 | Comparative Example 1 | Comparative Example 2 |
|---|---|---|---|
| Peripheral speed of brush means (mm/sec) | 152 | 400 | 392 |
| Variation rate of Peripheral speed of rotating drive source (%) | 1.58 | 2.23 | 2.22 |
| Variation rate of peripheral speed of rotating drum (%) | 4.79 | 8.95 | 8.92 |
| Local distortion of characters | None | Slight | Slight |

EXAMPLE 2

Figure 4:
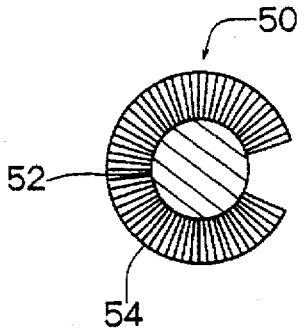
FIG. 4 is a sectional view showing the brush means used in Example 2 and Comparative Examples 3 and 4.

The rotations of the rotating drum, the rotating drive source and the brush means were measured, and the peripheral speed of the brush means, the variation rate of the peripheral speed of the rotating drive source, and the variation rate of the peripheral speed of the rotating drum were calculated, under substantially the same conditions as in Example 1, except that the brush means of the cleaning means which had no yarns in its 20-degree angular range was used, as illustrated in FIG. 4. Furthermore, 10 copies of an ordinary document containing many characters were prepared to check for local distortion of the characters on the copies. The results were as shown in Table 2.

Comparative Example 3

The rotations of the rotating drum, the rotating drive source and the brush means were measured, and the variation rate of the peripheral speed of the rotating drive source, and the variation rate of the peripheral speed of the rotating drum were calculated, under substantially the same conditions as in Example 2, except that the supporting shaft of the brush means in the cleaning means was drivably connected to the rotating drum via a transmission gear train, and that the brush means was positively rotationally driven at a peripheral speed of 400 mm/second. Furthermore, 10 copies of an ordinary document containing many characters were prepared to check for local distortion of the characters on the copies. The results were as shown in Table 2.

Comparative Example 4

The rotations of the rotating drum, the rotating drive source and the brush means were measured, and the variation rate of the peripheral speed of the rotating drive source, and the variation rate of the peripheral speed of the rotating drum were calculated, under substantially the same conditions as in Example 2, except that the supporting shaft of the brush means in the cleaning means was drivably connected to the rotating drum via a transmission gear train, and that the brush means was positively rotationally driven at a peripheral speed of 392 mm/second. Furthermore, 10 copies of an ordinary document containing many characters were prepared to check for local distortion of the characters on the copies. The results were as shown in Table 2.

TABLE 2

| | Example 2 | Comparative Example 3 | Comparative Example 4 |
|---|---|---|---|
| Peripheral speed of brush means (mm/sec) | 178 | 400 | 392 |
| Variation rate of peripheral speed of rotating drive source (%) | 2.14 | 5.02 | 4.99 |
| Variation rate of peripheral speed of rotating drum (%) | 11.46 | 26.42 | 26.36 |
| Local distortion of characters | Slight | Considerable | Considerable |

The results in Tables 1 and 2 above show that variations in the peripheral speed of the rotating drum can be decreased considerably if the brush means in the cleaning means is caused to rotate following the rotation of the rotating drum, instead of being positively driven rotationally. It is also seen that variations in the peripheral speed of the rotating drum can be made relatively small if the brush means is caused to rotate following the rotation of the rotating drum, even when the brush of the brush means is deformed in its specific angular portion.

Other Examples and Comparative Examples

Figure 5:
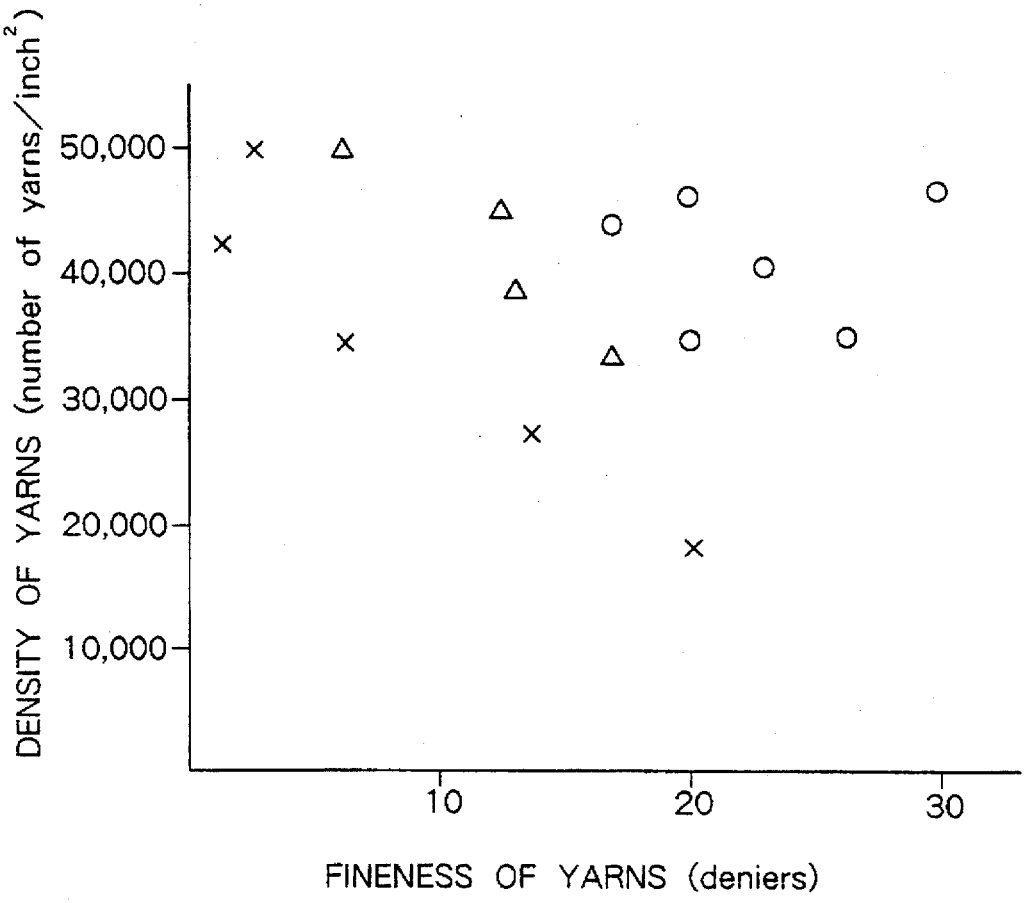
FIG. 5 is a diagrammatic view showing the relationship between the finenesses and densities of the yarns constituting the brush and the rotation of the brush means following the rotation of the rotating drum.

In the copying machine used in Example 1, the movement of the brush means following the rotation of the rotating drum was observed, with the fineness and density of the yarns constituting the brush of the brush means in the cleaning means being changed variously. The results are as shown in FIG. 5. In FIG. 5, the circle (○) represents that the brush means was caused to rotate smoothly following the rotation of the rotating drum even after 200 hours of continuous operation; the triangle (Δ) represents that the brush means was caused to rotate smoothly following the rotation of the rotating drum at the start of operation, but the rotation of the brush means was not smooth but nonuniform in speed or intermittent after 200 hours of continuous operation; and the cross (x) represents that the brush means was not caused to rotate smoothly from the beginning of operation.

FIG. 5 shows that in order to cause the brush means sufficiently smoothly following the rotation of the rotating drum, the fineness of the yarns constituting the brush is desirably greater than about 18 deniers, and the density of the yarns is desirably larger than about 40,000 yarns/inch$^2$. If the fineness and density of the yarns are too large, on the other hand, the torque necessary for the rotation of the rotating drum tends to increase, and the variation rate of the peripheral speed of the rotating drum also tends to increase. Hence, it is desirable that the fineness of the yarns be not more than about 50 deniers, and the density of the yarns be not more than about 70,000 yarns/inch$^2$.

What we claim is:

1. An image forming machine comprising a rotating drum mounted rotatably and having a photosensitive material disposed on the peripheral surface thereof; a rotating drive source for causing the rotating drum to rotate; an image forming means for forming a toner image on the photosensitive material in an image forming zone; a transfer means for transferring the toner image on the photosensitive material onto an image receiving member in a transfer zone located downstream of the image forming zone as viewed in the direction of rotation of the rotating drum; and a cleaning means which acts on the photosensitive material in a cleaning zone located downstream of the transfer zone but upstream of the image forming zone as viewed in the direction of rotation of the rotating drum;

wherein the cleaning means includes a brush means having a cylindrical brush formed of a multiplicity of radially extending yarns;

the brush of the cleaning means is mounted rotatably about the central axis of rotation extending substantially parallel to the central axis of rotation of the rotating drum, is pressed against the photosensitive material, and is caused to rotate following the rotation of the rotating drum; and the yarn constituting the brush has a density that is greater than 40,000 yarns/inch$^2$ and no more than 70,000 yarns/inch$^2$.

2. The image forming machine of claim 1 wherein the fineness of the yarns constituting the brush is 18 to 50 deniers.

3. The image forming machine of claim 1 wherein the length in the radial direction of the yarns constituting the brush is 3 to 7 mm.

4. The image forming machine of claim 1 wherein the yarns constituting the brush are conductive, and a direct current cleaning voltage is applied between the brush and the photosensitive material.

5. The image forming machine of claim 4 wherein the yarns constituting the brush are carbon-containing rayon yarns.

6. The image forming machine of claim 1 wherein the cleaning means includes a rubber blade to be pressed against the photosensitive material on the downstream side of the brush as viewed in the direction of rotation of the rotating drum.

7. The image forming machine of claim 1, wherein the cleaning means further includes a spiral blade mechanism located adjacent to said brush.

* * * * *